US005958331A

United States Patent [19]

Mizuguchi et al.

[11] Patent Number: 5,958,331

[45] Date of Patent: Sep. 28, 1999

[54] FE-NI BASED ALLOY SHEET HAVING SUPERIOR SURFACE CHARACTERISTIC AND SUPERIOR ETCHABILITY

[75] Inventors: Takeo Mizuguchi, Matsue; Makoto Ishihara, Shiname-ken; Tetsunori Hayafuji, Yasugi; Hidemi Takao, Matsue, all of Japan

[73] Assignee: Hitachi Metals, Ltd., Tokyo, Japan

[21] Appl. No.: 09/062,559

[22] Filed: Apr. 20, 1998

[30] Foreign Application Priority Data

Apr. 22, 1997 [JP] Japan ..... 9-118759

[51] Int. Cl.[6] ..... C22C 38/40; C22C 19/03

[52] U.S. Cl. ..... 420/94; 420/581; 420/452; 148/336

[58] Field of Search ..... 420/94, 581, 452; 148/336

[56] References Cited

U.S. PATENT DOCUMENTS 5,605,581 2/1997 Inoue et al. ..... 420/94

*Primary Examiner*—Deborah Yee

*Attorney, Agent, or Firm*—Sughrue, Mion, Zinn, Macpeak & Seas, PLLC

[57] ABSTRACT

A Fe—Ni based alloy sheet having superior surface characteristic and superior etchability, essentially consisting, by weight, of 30 to 50% nickel, 0.05 to 0.5% manganese, 0.001 to 0.02% silicon, not more than 0.0015% aluminum, not more than 150 ppm oxygen, and the balance iron and incidental impurities, the value of Mn content(weight %)/Si content (weight %) being not less than 20. Preferably, silicon content is 0.001 to 0.01%, aluminum being not more than 0.0005%, oxygen being not more than 90 ppm, sulfur which is one of important impurities being not more than 0.005%, and boron which is one of important impurities being not more than 0.005%.

18 Claims, 3 Drawing Sheets

FE-NI BASED ALLOY SHEET HAVING SUPERIOR SURFACE CHARACTERISTIC AND SUPERIOR ETCHABILITY

BACKGROUND OF THE INVENTION

The invention relates to a Fe—Ni based alloy sheet having superior surface characteristic and superior etchability (i.e., superior etchability means that etching can be performed in a good state), which sheet is suitable for producing a shadow mask used in a display, a lead frame for an integrated circuit (IC) and etc.

Hitherto, a Fe—Ni based alloy sheet has been used as a raw material for electronic parts such as a shadow mask and an IC lead frame etc.

The Fe—Ni based alloy sheet for the electronic parts is subjected to, for example, such a fine photoetching working as to form electron-transmitting holes regarding the shadow mask and inner leads regarding the IC lead frame. However, in view of recent higher degree of precise-and-fine design and higher integration design, both of further enhancement of the etchability and further thinner design of the sheet have been required.

As means for improving the etchability, hitherto, reducing of the amount of $Al_2O_3$ inclusions which is hardly etched and making the size of $Al_2O_3$ finer have been tried, however, reducing of segregation of components such as Ni which segregation becomes the cause of the roughness of an etched surface is recently noted. As means for further achieving the thinner sheet design, it is noted to reduce the amount of the $Al_2O_3$ inclusions.

In a conventional refining step for producing the Fe—Ni based alloy, Al having high deoxidizing ability has been used during the step of deoxidizing treatment as a main deoxidizer. Thus, in a resultant molten metal having been refined, $Al_2O_3$ remains which occurs during the deoxidization performed by Al, with the result that $Al_2O_3$ inclusions are confirmed to exist even in the structure of a Fe—Ni based alloy ingot. Since the $Al_2O_3$ inclusions are high in melting point and in hardness, the $Al_2O_3$ inclusions are hardly dissolved or dispersed even after forging and soaking treatment performed as to the Fe—Ni based alloy ingot, and the $Al_2O_3$ inclusions are inferior in elongation during hot rolling and it is hardly impossible to make the $Al_2O_3$ inclusions fine in size even after the Fe—Ni based alloy had been cold-rolled.

Thus, in a case of a sheet having a thickness of 0.25 mm, there occurs such a fear as the $Al_2O_3$ inclusions are exposed on the surface thereof, which exposure becomes the cause of roll scratches and another cause of surface defects of the sheet and which exposure further becomes the cause of quality deterioration such as etching inferiority and distortion of a pattern configuration after the etching.

Further, in a case where it is intended to make a conventional Fe—Ni based alloy sheet have a thickness of 0.15 mm in order to achieve the further enhancement of characteristics, the occurrence of the surface flaw (surface defect) is more marked, that is, the thickness of 0.15 mm is a threshold value so far as the conventional Fe—Ni based alloy sheet is concerned.

In order to address the problems, for example, JP-A-7-252604 proposes a method of obtaining superior surface characteristic by limiting the amount of Al in Fe—Ni based alloy into a level of 0.02% and preferably not more than 0.01% so that the occurrence of $Al_2O_3$ inclusions inferior in elongation during rolling may be suppressed.

As a method of decreasing Ni component segregation occurring in the Fe—Ni based alloy, for example, each of JP-A-60-128253 and JP-A-1-252725 proposes a method of applying soaking treatment to an ingot or slab.

The methods explained above are effective to reduce the surface flaws and the Ni segregation both occurring in the Fe—Ni based alloy. However, even in a case of adopting the method of JP-A-7-252604, it is impossible to sufficiently reduce $Al_2O_3$ inclusions in the structure, and problems remain regarding the improvement in both of the surface characteristic and etchability of the Fe—Ni based alloy sheet. Further, even in a case of adopting the methods of JP-A-60-128253 and JP-A-1-252725, it is impossible to sufficiently reduce Ni segregation and a problem still remains regarding the improvement in etchability.

SUMMARY OF THE INVENTION

The object of the invention is to obtain Fe—Ni based alloy sheet having both superior surface characteristic and superior etchability even in a case where the sheet is thinned to have a thickness not more than 0.15 mm, which object is achieved by suppressing surface flaws caused by inclusions and by reducing the segregation of Ni and Mn.

The inventors performed detailed research regarding a relation between $Al_2O_3$ inclusions existing in Fe—Ni based alloy and conditions due to which the inclusions occur. As a result of the research, it has discovered that the degree of occurrence of the $Al_2O_3$ inclusions existing in the alloy structure is greatly influenced on both elements other than Al and the ranges thereof in addition to the content of aluminum. Further, in order to reduce the amount of the $Al_2O_3$ inclusions existing in the Fe—Ni based alloy, the inventors performed detailed research regarding the abilities of deoxidizers while considering the respect that Mn and Si as well as Al are used as the deoxidizers for the Fe—Ni based alloy, and regarding the characteristic of the inclusions remaining in the sheet after the production of the sheet. As a result of the research, it has discovered that, in a case where the main of the inclusions existing in the structure of the Fe—Ni based alloy sheet is conditioned to become MnO—$SiO_2$ type eutectic composition, both the surface characteristic and etchability become superior in addition to a sufficient deoxidization degree. Further, as a result of still another research regarding alloy composition suited to obtain inclusions including the MnO—$SiO_2$ type eutectic composition as the main thereof, it has found that both the adjusting the contents of Si and O (oxygen) into appropriate ranges and the controlling of the ratio of Mn content to Si content are most important in addition to the decrease in the amount of Al.

In the Fe—Ni based alloy sheet in which the amount of the $Al_2O_3$ inclusions in the structure is reduced by conditioning the amounts of Si and O and by controlling the ratio of Mn content to Si content, it is possible to stabilize the MnO—$SiO_2$ type eutectic composition in the inclusions existing in the structure in addition to the decrease in the amount of the $Al_2O_3$ inclusions which are hardly etched, and it is further possible to reduce the segregation of Ni and Mn in the structure, with the result that the surface characteristic and etchability can be enhanced.

That is, the Fe—Ni based alloy sheet of the invention consist essentially, by weight, of 30 to 50% Ni, 0.05 to 0.5% Mn, 0.001 to 0.02% Si, not more than 0.0015% Al, not more than 150 ppm O (oxygen), and the balance Fe and incidental impurities, the value of Mn content (weight %)/Si content (weight %) being not less than 20. In the Fe—Ni based alloy sheet of the invention, it is possible to obtain superior surface characteristic and superior etchability, and it is also possible to obtain sufficient deoxidation degree and to further improve the surface characteristic and etchability by making the main of inclusions in the structure become the MnO—$SiO_2$ type eutectic composition. Preferably, the composition of the Fe—Ni based alloy sheet is conditioned so that aluminum (Al) is not more than 0.0005%, or so that oxygen (O) is not more than 90 ppm, or so that silicon (Si) is 0.001 to 0.01%, or so that the value of Mn content (weight %)/Si content (weight %) is not less than 60. Further, in the Fe—Ni based alloy sheet of the invention, the contents of S and B may be conditioned to be not more than 0.005% and not more than 0.005%, respectively, so as to enhance the hot workability.

In this Fe—Ni based alloy sheet of the invention, it is possible to obtain superior surface characteristic and superior etchability even in a case of such a reduced thickness as to be not more than 0.15 mm.

As means for estimating the morphology of the "inclusions having MnO—$SiO_2$ type eutectic composition as the main thereof" in the invention, it is possible to use, for example, a ratio of the portion of the MnO—$SiO_2$ type eutectic composition to the whole inclusions confirmed in the section of the sheet structure. In this case, in the inclusion morphology capable of achieving the object of the invention, the ratio of the portion of the MnO—$SiO_2$ eutectic composition to the whole inclusions must be not less than 50 area %.

DETAILED EXPLANATION OF THE INVENTION

Figure 1:
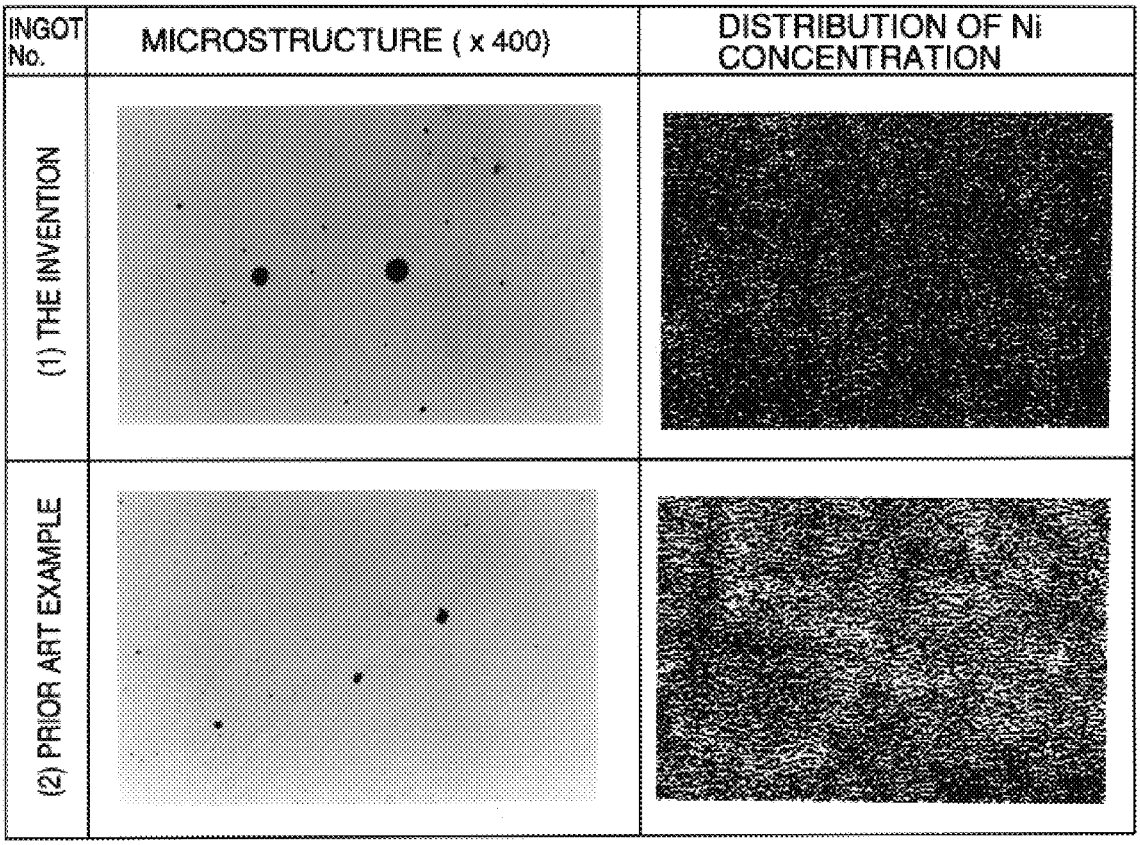
FIG. 1 is photomicrographs and sketches showing the segregation of Ni of Fe—Ni based alloy ingots of the invention and of prior art.

One of the most important features of the invention resides in the respects that the amount of AL(aluminum) is reduced, and that the contents of Si and O (oxygen) are adjusted to appropriate ranges while controlling the value of Mn content (weight %)/Si content (weight %) to an appropriate range, in order that the main of the inclusions in the structure becomes MnO—$SiO_2$ type eutectic composition, with the result that it becomes possible to obtain Fe—Ni based alloy sheet having superior surface characteristic and superior etchability.

In conventional Fe—Ni based alloy sheet, both the composition of inclusions and a method of controlling the inclusions were insufficient, and particularly the decrease in the amount of $Al_2O_3$ inclusions in the structure was in sufficient, so that there was a fear of the occurrence of surface flaws during rolling steps. That is, in the conventional refining step for producing the Fe—Ni based alloy, aluminium was used as a main deoxidizer used for the deoxidizing treatment, with the result that relatively high amount of $Al_2O_3$ inclusion occurred in the structure of a steel ingot. Since the $Al_2O_3$ inclusion is one having high hardness and a high melting point not less than 1600° C., neither dissolving (disintegration) nor diffusion thereof occurs even after both a forging step and a soaking treatment performed after an ingot-making step, so that on the surface of the sheet after rolling there occur flaws caused by the $Al_2O_3$ inclusion.

Thus, in order to minimize the occurrence of the surface flaws after rolling, the inventors researched means for deoxidization which can replace the conventional method in which aluminum was used as a main deoxidizer. As a result of the research, the inventors have discovered that, by optimally regulating the contents of Si and O (oxygen) and the value of Mn content/Si content, it becomes possible to sufficiently perform deoxidizing treatment even when the amount of the aluminum which is one of effective deoxidizers is reduced, with the result that it become possible to obtain Fe—Ni based alloy sheet having superior surface characteristic. On the basis of the finding, the inventors have further researched an interrelation between the state of the $Al_2O_3$ inclusion in the structure and the ratio of Mn content/Si content, so that the inventors have found optimal alloy compositions for obtaining superior surface characteristic.

Namely, in a Fe—Ni based alloy sheet controlled to satisfy the composition of the invention, superior surface characteristic can be obtained because of sufficient decrease in the amount of the $Al_2O_3$ inclusion together with the achievement of sufficient deoxidizing treatment, and defective etching caused by the $Al_2O_3$ inclusion can be sufficiently reduced. Further, by performing the deoxidizing treatment in which Mn and Si are mainly used together with the optimal adjustment of the balance of the amounts of the used Mn and Si so that the main of inclusions existing in sheet structure may become MnO—$SiO_2$ type eutectic composition, it becomes possible to obtain further enhanced surface characteristic and etchability regarding the sheet.

Figure 3:
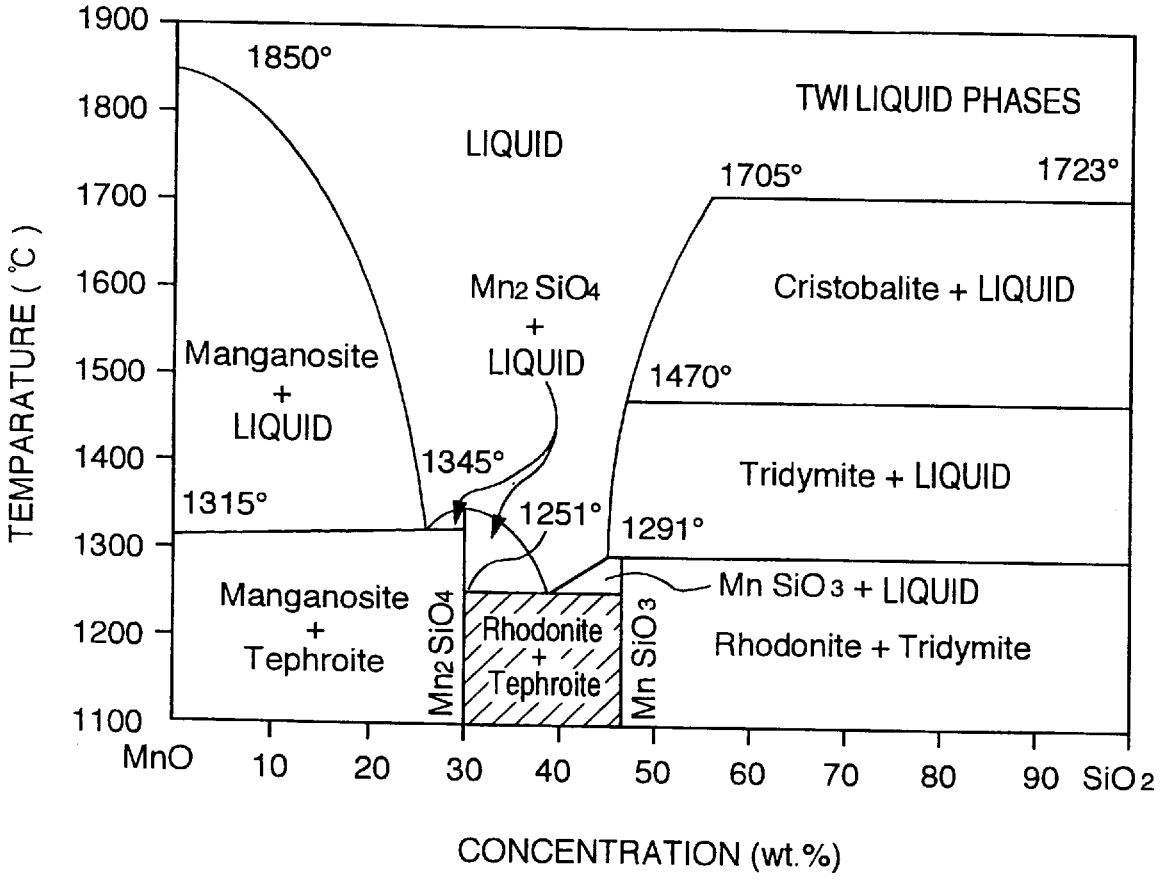
FIG. 3 is a binary state diagram of MnO—$SiO_2$ (disclosed in Steel Handbook Vol. 3) explaining the MnO—$SiO_2$ eutectic composition relating to the invention.

Then, the MnO—$SiO_2$ type eutectic composition is explained below. FIG. 3 is a well known binary constitutional diagram of MnO—$SiO_2$ (disclosed in Steel Handbook Vol.3), which is effective to explain the characteristic of the MnO—$SiO_2$ eutectic composition. In FIG. 3, the term "MnO—$SiO_2$ type eutectic composition" used in the specification is defined to be a composition range (Rhodonite+tephroite) surrounded by compositions having $Mn_2SiO_4$ and $MnSiO_3$, which are found to have melting points lower than that of other MnO—$SiO_2$ binary composition range as well as the melting point of $Al_2O_3$. That is, in a case where the main of the inclusions existing in the Fe—Ni based alloy structure is MnO—$SiO_2$ type eutectic composition having low melting point and low hardness, it becomes possible to make the inclusions sufficiently fine in size and to make the inclusions sufficiently elongated, under the conventional conditions of forging and at a conventional hot rolling temperature, with the result that both of surface flaws caused by the inclusions and defective etching can be prevented from occurring together with the achievement of sufficient deoxidizing treatment. Particularly, the eutectic composition of about 62 wt. % MnO—$SiO_2$ has the lowest melting point and is a preferable inclusion composition in the invention.

Another feature of the Fe—Ni based alloy sheet of the invention resides in the respect that the occurrence of Ni and Mn segregation is reduced in the structure in comparison with conventional Fe—Ni based alloy sheet. In the conventional Fe—Ni based alloy sheet, since the composition segregation of Ni and Mn is marked in the structure, there is such a fear as roughness called "line unevenness" occurs, due to the segregation of Ni and Mn, on a pattern face after etching. Thus, the inventors have also researched in detail the degree of occurrence of the composition segregation of Ni and Mn which segregation occurs in the structure, so that it has found that the decrease in the amount of $Al_2O_3$ in the structure is effective to reduce the Ni and Mn segregation. That is, it has found that solidification in an ingot-making step affects both the occurrence of and degree of the Ni and Mn segregation and that $Al_2O_3$ of high melting point existing in Fe—Ni alloy melt also affects these occurrence and degree.

In the Fe—Ni based alloy sheet of the invention to which such deoxidizing treatment as the main of inclusions existing in the sheet structure becomes MnO—$SiO_2$ is applied, the amount of $Al_2O_3$ has already been reduced during the solidification thereof, and in the course of the solidification and in heat treatment there are formed inclusions including Mn, with the result that Ni and Mn segregation is reduced. Thus, in the Fe—Ni based alloy sheet of the invention, it is also possible to reduce defective etching apt to occur due to the Ni and Mn segregation. Further, in the invention, the inclusions including the MnO—$SiO_2$ type eutectic composition as the main thereof can be distributed finely in the structure of the sheet, so that it becomes possible to achieve a further improved etching property. Namely, as explained above, since the range of the MnO—$SiO_2$ type eutectic composition is low in melting point in comparison with other MnO—$SiO_2$ binary composition ranges as well as $Al_2O_3$, it is possible to achieve the fine distribution through both of solution treatment and precipitation by applying soaking treatment to the ingot and the slab prepared after an ingot-making step. As regards the temperature of the soaking treatment for obtaining the effect of the solution treatment and precipitation, this effect can be obtained when this temperature is not less than the eutectic temperature in the MnO—$SiO_2$ binary constitutional diagram which temperature is not less than 1251° C. in the case of FIG. 3. Preferably, the temperature of the soaking treatment is not less than 1270° C., by which it is possible to achieve the superior effect of the solution treatment and precipitation.

In addition, as explained above, the inclusions including the MnO—$SiO_2$ type eutectic composition as the main thereof which inclusions are dispersed in the structure can be made to be further fine in size by forging or hot-rolling. Namely, since the MnO—$SiO_2$ type eutectic composition range is low in melting point and in hardness, even conventional forging temperature and conventional hot rolling temperature can make the inclusions fine in size in a case where the main of the inclusions is this MnO—$SiO_2$ type eutectic composition. For example, by making this temperature not less than 1100° C. it becomes possible to simultaneously obtain both of the sufficient effect of making the inclusions fine in size and superior surface characteristic brought about from the excellent elongation.

Then, the effect of the invention is explained below in the drawings.

FIG. 1 shows a structure of a Fe—Ni based alloy ingot subjected to a soaking treatment for 40 hours at 1280° C. after an ingot-making step. In FIG. 1 the left side thereof is a micrograph obtained through the observation by use of an optical microscope of 400 times, which micrograph is used to estimate inclusions, and the right side thereof shows the data of the Ni concentration distribution obtained through face analysis by use of EPMA, in which data the white colour portions indicate the high content of Ni and in which it is indicated that, the larger difference between the light and the shade a portion has, the larger the concentration difference of Ni is, that is, the segregation of Ni occurs in a high degree.

In FIG. 1 the ingot No. 1 meets the composition of Sample No. 4 in the embodiment disclosed hereinbelow, which ingot No. 1 corresponds to the Fe—Ni based alloy sheet of the invention, the prior art ingot No. 2 corresponding to Sample No. 25 made while applying conventional intensive deoxidization by use of Al deoxidizer. In the microstructure of the prior art ingot No. 2 in FIG. 1 there are observed many $Al_2O_3$ type inclusions. As explained above, the $Al_2O_3$ type inclusions are hardly dissolved or diffused even after forging performed thereafter, are inferior in elongation in hot rolling, and do not become fine in size after cold rolling, with the result that the ingot No. 2 in FIG. 1 has such a fear as flaws occur on the surface of sheet formed from this ingot. On the other hand, in the microstructure of the ingot No. 1 in FIG. 1 corresponding to the invention, the amount of $Al_2O_3$ type inclusions is reduced and spherical inclusions are observed instead of the $Al_2O_3$ type inclusions. After the study and analysis thereof, it has found that the spherical inclusions are MnO—$SiO_2$ type eutectic type composition.

Further, in the photographs disclosing the Ni segregation of the ingot structure, it has found, from the respect that difference between light and shade varies locally which difference shows the variation of Ni concentration, that in the prior art ingot No. 2 in which much amount of $Al_2O_3$ type inclusions remain, Ni segregation occurs in a great degree. However, in the ingot No. 1 of the invention, the difference between light and shade is relatively reduced, that is, the segregation of Ni is substantially restrained.

Figure 2:
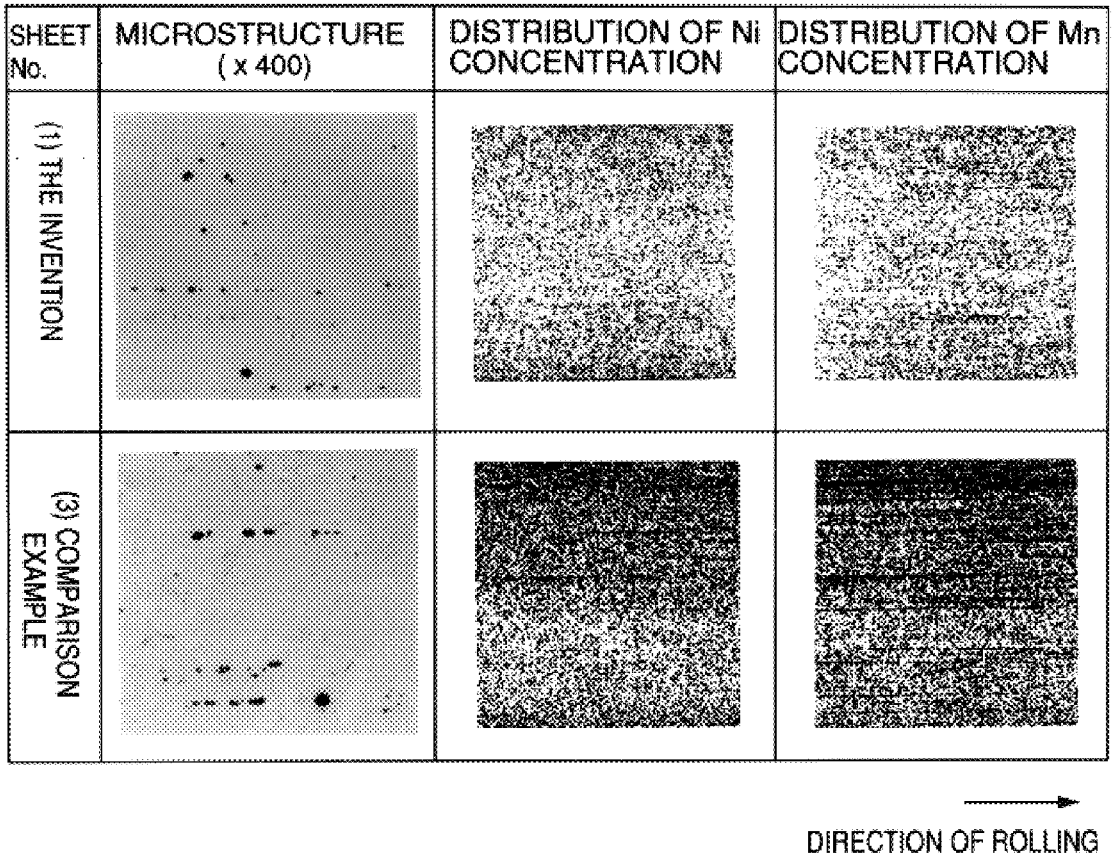
FIG. 2 is photomicrographs and sketches showing the segregation of Ni and Mn of Fe—Ni based alloy sheets of the invention and of prior art.

FIG. 2 shows the structures of Fe—Ni based alloy sheets each formed by the steps of applying a soaking treatment of 40 hours at 1280° C. to the ingot, forging the ingot and hot-rolling the slab, and repeating the cold rolling and annealing. In FIG. 2 the left side is micrographs obtained by use of an optical microscope of 400 times, which micrographs are used to estimate the inclusions, and the center and right sides thereof show the data of Ni and Mn concentration distribution represented by light and shade (, the light portions being Ni or Mn concentrated portions), which data are obtained by the face analysis of the alloy sheets through EPMA. In the Ni and Mn concentration distribution, the larger the difference between the light and the shade, the larger the segregation of Ni or Mn becomes. In FIG. 2, the sheet No. 1 meets the composition of Sample No. 4 in the embodiment disclosed hereinbelow, which sheet corresponds to the Fe—Ni based alloy sheet of the invention. The sheet No. 3 is a prior art example corresponding to Sample No. 26 to which prior art intensive deoxidization was applied by use of conventional Al deoxidizer.

In the micrograph of the prior art sheet No. 3, there are observed many $Al_2O_3$ type inclusions, which $Al_2O_3$ type inclusions are inferior regarding the degrees of both elongation in the direction of rolling and fineness (minuteness) in size. As explained above, the $Al_2O_3$ type inclusions existing in the structure of a Fe—Ni based alloy ingot formed through an ingot-making step are hardly dissolved and are hardly diffused even after forging performed thereafter. Further, since the $Al_2O_3$ type inclusions are inferior in the respect of elongation and can not be made to be fine in size even after cold-rolling, there occurs such a fear as flaws are caused on the surface of the sheet.

On the other hand, in the case of the micrograph of the sheet No. 1 of the invention, it is observed that the amount of the $Al_2O_3$ type inclusions are reduced, that MnO—$SiO_2$ type eutectic composition exist instead thereof, and that the latter is very fine in size and is elongated in a great degree in the direction of rolling. Since the MnO—$SiO_2$ type eutectic composition is low in both melting point and hardness, it becomes possible, by use of conventional forging and hot-rolling temperature, to make the inclusions sufficiently fine in size and sufficiently elongated in a case where the main of the inclusions existing in the Fe—Ni based alloy structure is the MnO—$SiO_2$ type eutectic composition. Thus, in the Fe—Ni based alloy sheet of the invention in which the main of the inclusions existing in the structure is controlled to be the MnO—$SiO_2$ type eutectic composition, it becomes possible to prevent both of surface flaws and etching inferiority from being caused by the inclusions.

Further, in FIG. 2 showing the Ni and Mn segregation in the sheet structure, the comparison example No. 3 has local variations of the light-and-shade which shows the concentration variation of Ni and Mn components, so that it is found that the Ni and Mn segregation occur greatly. However, in the sheet No. 1 of the invention the variation of the light-and-shade is substantially reduced, that is, the Ni and Mn segregation is substantially reduced. That is, in the invention the Ni and Mn segregation occurring during the ingot-making step can be sufficiently reduced in comparison with prior art technique, and by use of forging and soaking treatment both performed after the ingot-making step, the further decrease in the Ni and Mn segregation becomes possible because of the diffusion, with the result that the etchability of the sheet is enhanced.

When obtaining the effect of the Fe—Ni based alloy sheet of the invention, a continuous casting method may be use without using any ingot-making method. In the case of the continuous casting method, since the amount of the $Al_2O_3$ type inclusions is reduced in the melt of the Fe—Ni based alloy, there is no need to provide in a tandish any means for removing the $Al_2O_3$ such as, for example, a filter with the result that the cost of the production becomes advantageous.

Then, regarding the Fe—Ni based alloy sheet capable of achieving the effect of the invention, the reasons for numerically limiting each of the constituents are explained hereinbelow.

Ni is an element greatly influencing the low thermal expansion characteristic of the Fe—Ni based alloy. In a material for electronic parts such as lead frames for IC and shadow masks etc., it is necessary for the material to have a thermal expansion coefficient approximate to those of Si chips and glass materials used for packages and cathode-ray tubes. Particularly, regarding a shadow mask, this low thermal expansion coefficient is indispensable to prevent colour misalignment from occurring. Ni content in order to achieve the effect is 30 to 50% (, which % means weight % in the specification unless otherwise limited).

Mn is one of deoxidation elements and at the same time is an element for regulating inclusions in the structure so that the main of the inclusions may become MnO—$SiO_2$ type eutectic composition. In a case where the amount of Mn is less than 0.05%, the deoxidation effect becomes insufficient, and etching rate is lowered in ant other case where the amount of Mn is more than 0.5%. Thus, the content of Mn is 0.05 to 0.5%.

Si is one of the deoxidation elements and at the same time is an element for regulating inclusions in the structure so that the main of the inclusions may become MnO—$SiO_2$ type eutectic composition, in the same manner as Mn. In a case of Si less than 0.001% the deoxidation effect become inferior, so that the lower limit of Si content is limited to 0.001%. On the other hand, an excessive amount of Si becomes the cause of the occurrence of such inclusions as to be detrimental to surface characteristic and etchability. Thus, the upper content of Si for achieving the effect of the invention is limited to be 0.02%, and preferably to be not more than 0.01%.

Al is a main element causing $Al_2O_3$ type inclusions, and it is preferable to reduce the amount of Al. In the invention, by reducing Al amount so that the Al amount may become not more than 0.0015%, problems caused by Al can be substantially prevented. Thus, the upper limit of Al is 0.0015%. Further, by reducing the amount of Al so that the amount thereof may become not more than 0.001%, it becomes possible to further reduce the amount of the $Al_2O_3$ type inclusions. Thus, it is preferable to make the amount of Al not more than 0.0005%.

In a case where it is intended to further reduce the Ni and Mn segregation in the invention, it is preferable to reduce the amount of Al in melt in the ingot-making step. Specifically, the amount of Al in the sheet is regulated to be not more than 0.0015%, preferably not more than 0.0010%, and more preferably not more than 0.0005%, and by making the main of the inclusions in the sheet structure become MnO—$SiO_2$ type eutectic composition, it becomes possible to sufficiently reduce the Ni and Mn segregation. Further, the decrease in the amount of Al is effective for stabilizing the MnO—$SiO_2$ type eutectic composition existing in the structure. Thus, the amount of Al is not more than 0.0015%, preferably not more than 0.0010%, and more preferably not more than 0.0005%.

O (oxygen) is one of the important elements in the alloy, which oxygen controls, in accordance with the amounts of Mn and Si contained in the alloy, the total amount of inclusions including the MnO—$SiO_2$ type eutectic composition as the main thereof. However, in a case where oxygen is contained excessively, it become the causes of the occurrence of inclusions such as $SiO_2$ which is detrimental to surface characteristic and etchability. Thus, the amount of oxygen is limited to be not more than 150 ppm, and preferably not more than 90 ppm.

Then, the value of the ratio, Mn content (wt. %)/Si content (wt. %), important to achieve the effect of the invention is explained below. As disclosed above, Si in the invention is an element to be combined with Mn and O in the melt so that the inclusions including the MnO—$SiO_2$ type eutectic composition as the main thereof may occur. However, in a case where the Si content is large in comparison with the Mn content, the amount of $SiO_2$ type inclusion occurring in the alloy becomes large with the result that the surface characteristic and etchability are influenced badly. That is, since Si has larger affinity for oxygen than Mn, the main of the inclusions in the structure becomes $SiO_2$ predominantly in a case where excessive amount of Si is contained in comparison with the predetermined amount of Mn.

It is desired to reduce the amount of $SiO_2$ type inclusion because it becomes the cause of the occurrence of inferior surface characteristic and inferior etchability as explained above. Thus, the inventors have searched the optimal range of the Mn content (wt. %)/Si content (wt. %) for the purpose of reducing the $SiO_2$ type inclusion together with the research for the occurrence of the MnO—$SiO_2$ type eutectic composition existing as the main of the inclusions. As a result thereof, it has found that, in order to achieve the effect of the invention, it is important to make the amount of Mn larger at least 20 times (weight % ratio) than the amount of Si together with not more than 150 ppm O (oxygen). Thus, in the Fe—Ni based alloy sheet of the invention, the value of the Mn content (wt. %)/Si content (wt. %) is limited to be not less than 20, and preferably not less than 60.

Further, in the invention, by regulating the amount of each of S and B, further enhancement of hot workability is possible.

S segregates in grain boundaries in the alloy and makes the grain boundaries brittle, so that S becomes the cause of grain boundary fracture during hot-working. Thus, in the invention, the amount of S is limited to be not more than 0.005%.

Similarly to S, B also make the grain boundaries brittle and becomes the cause of grain boundary fracture during hot-working. Thus, the amount of B is limited to be not more than 0.005%.

Accordingly, in the invention, the amount of Si and O (oxygen) are appropriately regulated together with the reduction of the amount of Al, the ratio of Mn content (wt. %)/Si content (wt. %) being controlled, and the inclusions in the structure are regulated to become the MnO—$SiO_2$ type eutectic composition as the main of the inclusions, so that it becomes possible to reduce the amount of $Al_2O_3$ type inclusion, to enhance the elongation of the inclusions remaining in the structure, and to make the inclusions fine in size to reduce the Ni and Mn segregation, together with the sufficient deoxidation treatment. As a result thereof, even in a case where the thickness of the sheet is thinned to be not more than 0.15 mm for the purpose of enhancing the characteristics, it becomes possible to achieve superior surface characteristic and superior etchability.

In achieving the effect of the invention, preferable Fe—Ni based alloy sheet may essentially consist, by weight, of 30 to 50% Ni, 0.05 to 0.5% Mn, 0.001 to 0.01% Si, not more than 1 ppm Al, 60 to 70 ppm O (oxygen), and the balance Fe and incidental impurities, the value of Mn content (wt. %)/Si content (wt. %) being not less than 20.

PREFERRED EMBODIMENTS OF THE INVENTION

The embodiments of the invention are disclosed below.

First, prior to the production of samples, Fe—Ni based alloy melt regulated to have a predetermined composition by vacuum melting was cast to thereby obtain a alloy ingot. Then, after the ingot had been subjected to a soaking treatment for 40 hours at 1280° C., a slab for hot-rolling was formed by forging the ingot. After hot-rolling the Fe—Ni based alloy slab, the steps of annealing and cold-rolling were repeated to thereby obtain Fe—Ni based alloy sheets having predetermined thicknesses, from which sheets both the samples of the invention and comparison samples were prepared. Table 1 shows the sheet thicknesses and the compositions regarding the present invention and the comparison examples.

TABLE 1

| Sample No. | Thickness of sheet (mm) | Chemical Composition (mass %) C | Ni | Mn | Si | Al | O* | S | B | Fe | Mn/Si | Rate of Eutectic MnO—$SiO_2$ (in % by area) | Surface Characteristics | Etchability | Remarks |
|---|---|---|---|---|---|---|---|---|---|---|---|---|---|---|---|
| 1 | 0.25 | 0.0036 | 36.0 | 0.33 | 0.014 | 0.0012 | 148 | 0.0006 | — | bal. | 23.6 | 81 | Δ | Δ | This invention |
| 2 | 0.25 | 0.0033 | 35.8 | 0.36 | 0.015 | 0.0008 | 145 | 0.0008 | — | bal. | 24.0 | 85 | Δ | Δ | |
| 3 | 0.23 | 0.0032 | 36.2 | 0.25 | 0.012 | 0.0007 | 125 | 0.0008 | 0.0042 | bal. | 20.8 | 93 | Δ | Δ | |
| 4 | 0.20 | 0.0030 | 35.9 | 0.30 | 0.008 | 0.0005 | 85 | 0.0007 | — | bal. | 37.5 | 100 | ○ | ○ | |
| 5 | 0.20 | 0.0038 | 35.9 | 0.30 | 0.007 | 0.0001 | 73 | 0.0007 | — | bal. | 42.9 | " | ○ | ○ | |
| 6 | 0.20 | 0.0031 | 36.1 | 0.29 | 0.004 | 0.0006 | 69 | 0.0006 | 0.0001 | bal. | 72.5 | " | ○ | ○ | |
| 7 | 0.17 | 0.0032 | 36.0 | 0.37 | 0.016 | 0.0004 | 148 | 0.0007 | — | bal. | 23.1 | " | ○ | ○ | |
| 8 | 0.17 | 0.0032 | 36.0 | 0.37 | 0.010 | 0.0004 | 148 | 0.0007 | — | bal. | 37.0 | " | ○ | ○ | |
| 9 | 0.15 | 0.0029 | 36.1 | 0.33 | 0.005 | 0.0001 | 68 | 0.0005 | — | | | | | | |
| 10 | 0.15 | 0.0029 | 36.1 | 0.33 | 0.002 | 0.0001 | 68 | 0.0005 | — | | | | | | |
| 11 | 0.15 | 0.0031 | 35.9 | 0.28 | 0.009 | 0.0004 | 93 | 0.0006 | 0.0023 | | | | | | |
| 12 | 0.13 | 0.0032 | 36.2 | 0.26 | 0.003 | 0.0003 | 63 | 0.0004 | 0.0005 | | | | | | |
| 13 | 0.12 | 0.0037 | 36.0 | 0.32 | 0.003 | 0.0006 | 68 | 0.0005 | — | | | | | | |
| 14 | 0.25 | 0.0041 | 42.1 | 0.39 | 0.015 | 0.0010 | 144 | 0.0006 | — | | | | | | |
| 15 | 0.25 | 0.0030 | 41.9 | 0.45 | 0.019 | 0.0007 | 148 | 0.0007 | — | | | | | | |
| 16 | 0.20 | 0.0029 | 42.1 | 0.48 | 0.013 | 0.0004 | 131 | 0.0005 | — | | | | | | |
| 17 | 0.20 | 0.0033 | 42.0 | 0.43 | 0.007 | 0.0005 | 78 | 0.0004 | 0.0009 | | | | | | |
| 18 | 0.17 | 0.0034 | 41.8 | 0.44 | 0.009 | 0.0004 | 88 | 0.0005 | — | | | | | | |
| 19 | 0.15 | 0.0032 | 42.2 | 0.45 | 0.005 | 0.0002 | 67 | 0.0003 | 0.0001 | | | | | | |
| 20 | 0.15 | 0.0032 | 42.2 | 0.45 | 0.003 | 0.0002 | 67 | 0.0003 | 0.0001 | | | | | | |
| 21 | 0.13 | 0.0031 | 42.0 | 0.46 | 0.004 | 0.0001 | 62 | 0.0003 | — | | | | | | |
| 22 | 0.13 | 0.0031 | 42.0 | 0.46 | 0.002 | 0.0001 | 62 | 0.0003 | — | | | | | | |
| 23 | 0.20 | 0.0030 | 36.0 | 0.28 | 0.023 | 0.0007 | 173 | 0.0005 | — | | | | | | |
| 24 | 0.20 | 0.0030 | 35.9 | 0.25 | 0.007 | 0.0017 | 21 | 0.0004 | — | | | | | | |
| 25 | 0.15 | 0.0032 | 35.9 | 0.26 | 0.017 | 0.0081 | 22 | 0.0004 | — | | | | | | |
| 26 | 0.15 | 0.0032 | 35.9 | 0.26 | 0.017 | 0.0180 | 22 | 0.0004 | — | | | | | | |
| 27 | 0.15 | 0.0031 | 41.9 | 0.46 | 0.025 | 0.0004 | 161 | 0.0003 | — | | | | | | |

TABLE 1-continued

| | | | | | |
|---|---|---|---|---|---|
| bal. | 66.0 | " | ◎ | ◎ | |
| bal. | 165.0 | " | ◎ | ◎ | |
| bal. | 31.1 | " | ○ | ○ | |
| bal. | 86.7 | " | ○ | ○ | |
| bal. | 106.7 | " | ○ | ○ | |
| bal. | 26.0 | 81 | Δ | Δ | |
| bal. | 23.7 | 88 | Δ | Δ | |
| bal. | 36.9 | 100 | ○ | ○ | |
| bal. | 61.4 | " | ○ | ○ | |
| bal. | 48.9 | " | ○ | ○ | |
| bal. | 90.0 | " | ○ | ○ | |
| bal. | 150.0 | " | ○ | ○ | |
| bal. | 115.0 | " | ◎ | ◎ | |
| bal. | 230.0 | " | ◎ | ◎ | |
| bal. | 12.2 | 9 | X | X | Comparative Example |
| bal. | 35.7 | 15 | X | X | |
| bal. | 15.3 | 2 | X | X | |
| bal. | 15.3 | 0 | X | X | |
| bal. | 18.4 | 35 | X | X | |

*The amount of O (oxygen) is represented by "ppm".

Regarding the samples, the morphology of inclusions in the sample structure was researched. In the research of the morphology of the inclusions, the compositions of the inclusions in the section of the sample structure were first analyzed and confirmed by a scanning electron microscope and a X-ray spectrometer of energy-dispersing type. Then, on the basis of the analysis results, the section of the structure was image-analyzed, whereby the ratio (area %) of the MnO—$SiO_2$ type eutectic composition to the whole of the inclusions was obtained, the results of which are also shown in Table 1.

In each of sample Nos. 1 to 22 embodying the invention, the amount of $Al_2O_3$ type inclusions was reduced in the structure. Particularly, with the exception of sample Nos. 1 to 3, 14 and 15, the amounts of Al, Si and O (oxygen) were well balanced in the samples embodying the invention, so that no inclusion composition other than the MnO—$SiO_2$ type eutectic composition was confirmed.

On the other hand, in each of comparison sample Nos. 23 to 27, a large amount of inclusion in the structure was $Al_2O_3$ and $SiO_2$, and the ratio of the MnO—$SiO_2$ type eutectic composition to the whole inclusion is less than 50 area %.

As means for estimating the surface characteristic, the surface of each sheet was visually observed. In the visual observation, a sheet having no flaw caused by inclusions and having good surface characteristic is marked by "Δ", another sheet having better surface characteristic being marked by "○", still another sheet having the best surface characteristic being marked by "◎", and still another sheet having inferior surface characteristic is marked by "X". In this case, flaw caused by reasons (such as bad treatment) other than the inclusion was excluded from the estimation. The result of the estimation is also disclosed in Table 1.

Since in each of sample Nos. 1 to 22 embodying the invention the amount of $Al_2O_3$ type inclusions was reduced in the structure, substantially no flaw due to the inclusion was observed on the surface thereof, so that it was found that the Fe—Ni based alloy sheet had superior surface characteristic. In these samples, with the exception of sample Nos. 1 to 3, 14 and 15, the amounts of Al, Si and O (oxygen) were further reduced in the samples embodying the invention, so that the amount of $SiO_2$ as well as $Al_2O_3$ was reduced with the result that the surface characteristic was further enhanced. Particularly, each of sample Nos. 9, 10, 21 and 22 had very excellent surface characteristic because of the further reduced amount of Al. Regarding each of the sample Nos. 21 and 22, the very excellent surface characteristic was still held even in such a thinned thickness as to be 0.13 mm. On the other hand, in each of the comparison sample Nos. 23 to 27, since the inclusions of $Al_2O_3$ and $SiO_2$ types existed, surface flaws occurred and surface characteristic became inferior.

In each of sample Nos. 25 and 26, conventional intensive deoxisation treatment was performed by use of Al. However, as explained above, since many $Al_2O_3$ type inclusions existed in the structure, surface characteristic was inferior. Although sample No. 24 satisfied the content ratio of Mn/Si limited in the invention, many $Al_2O_3$ type inclusions still existed in the structure due to high level of Al amount in the step of refining, with the result that surface characteristic was inferior. Each of sample Nos. 23 and 27 satisfied the Al amount limited in the invention, however, many $SiO_2$ type inclusions existed due to the respect that Si amount was high and that the content ratio of Mn/Si is less than the range of the invention, so that the cleanness of the surface was degraded.

Thus, it has confirmed that in Fe—Ni based alloy sheet embodying the invention, it becomes possible to obtain superior surface characteristic even in a case where the thickness thereof is made to be not more than 0.15 mm.

Then, etching treatment was performed regarding each of the samples disclosed in Table 1 so that etchability might be estimated. As regards the conditions of the etching, a photoresist film provided with openings each having a diameter of 200 μm was formed on each of the samples, and then spray etching for 5 minutes at 60° C. was performed by use of a ferric chloride solution of 42 Baume degree. Regarding the estimation of the etchability, samples having etched holes in which neither distortion of the holes nor roughness on the surface thereof occurred is estimated to have good etchability and is marked by "Δ", another sheet having better etchability than this "Δ" being marked by "○", still another sheet having the best etchability being marked by "◎", and still another sheet having inferior etchability is marked by "X". The estimation result is also disclosed in Table 1.

In each of sample Nos. 1 to 22 embodying the invention, since the amount of $Al_2O_3$ type inclusion and Ni and Mn segregation were reduced, neither distortion (which was apt to occur on the surface and regarding the configuration of the etched holes) nor roughness was observed, and it was confirmed that Fe—Ni based alloy sheet embodying the invention had superior etchability. In these samples, with the exception of sample Nos. 1 to 3, 14 and 15, the amount of Al, Si, and O (oxygen) were further reduced in the samples embodying the invention, so that the amount of $SiO_2$ as well as $Al_2O_3$ was reduced with the result that the etchability was further enhanced. Particularly, each of sample Nos. 9, 10, 21, and 22 had very good etchability because the further reduced amount of Al was able to bring about both of the further reduction of $Al_2O_3$ type inclusions and the further decrease in Ni and Mn segregation.

On the other hand, in each of comparison sample Nos. 23 to 27, since the inclusions of $Al_2O_3$ and $SiO_2$ types existed together with noticeable segregation of Ni, inferior etchability occurred. In each of sample Nos. 25 and 26 in which conventional intensive deoxidation treatment was performed by use of Al, since many $Al_2O_3$ type inclusions remained in the structure together with noticeable segregation of Ni and Mn, the etchability was inferior. Although sample No. 24 satisfied the ratio of Mn content/Si content limited in the invention, many $Al_2O_3$ type inclusion and Ni and Mn segregation remained in the structure due to high level of Al amount in the step of refining, with the result that etchability was inferior. Each of sample Nos. 23 and 27 satisfied the Al amount limited in the invention, however, many $SiO_2$ type inclusions existed due to the facts that Si amount was high and that the ratio of Mn content/Si content is less than the range of the invention, so that the etchability was inferior.

In the invention, it becomes possible to obtain Fe—Ni based alloy sheet in which the amount of $Al_2O_3$ type inclusion is reduced together with the sufficient deoxidation, the elongation of the inclusions remaining in the structure being enhanced, the inclusions being made to be fine in size, and the Ni and Mn segregation are reduced. As a result thereof, even when the thickness of the sheet is thinned to be not more than 0.15 mm, the sheet has superior surface characteristic and superior etchability.

According to the Fe—Ni based alloy sheet of the invention, the quality of the materials used for electronic parts such as shadow mask and lead frame for IC etc. can be further enhanced without any substantial modification as to prior art production method, so that the industrial advantages brought about from the invention is very remarkable.

What is claimed is:

1. A Fe—Ni based alloy sheet having superior surface characteristic and superior etchability, essentially consisting, by weight, of 30 to 50% nickel, 0.05 to 0.5% manganese, 0.001 to 0.02% silicon, not more than 0.0015% aluminum, not more than 150 ppm oxygen, and the balance iron and incidental impurities, the value of Mn content(weight %)/Si content (weight %) being not less than 20.

2. A Fe—Ni based alloy sheet having superior surface characteristic and superior etchability according to claim 1, said Fe—Ni based alloy sheet having inclusions, said inclusions having a MnO—$SiO_2$ eutectic composition as the main component.

3. A Fe—Ni based alloy sheet having superior surface characteristic and superior etchability according to claim 1, said Fe—Ni based alloy sheet having a thickness not more than 0.15 mm.

4. A Fe—Ni based alloy sheet having superior surface characteristic and superior etchability, essentially consisting, by weight, of 30 to 50% nickel, 0.05 to 0.5% manganese, 0.001 to 0.02% silicon, not more than 0.0005% aluminum, not more than 150 ppm oxygen, and the balance iron and incidental impurities, the value of Mn content(weight %)/Si content (weight %) being not less than 20.

5. A Fe—Ni based alloy sheet having superior surface characteristic and superior etchability according to claim 4, said Fe—Ni based alloy sheet having inclusions, said inclusions having a MnO—$SiO_2$ eutectic composition as the main component.

6. A Fe—Ni based alloy sheet having superior surface characteristic and superior etchability according to claim 4, said Fe—Ni based alloy sheet having a thickness not more than 0.15 mm.

7. A Fe—Ni based alloy sheet having superior surface characteristic and superior etchability, essentially consisting, by weight, of 30 to 50% nickel, 0.05 to 0.5% manganese, 0.001 to 0.01% silicon, not more than 0.0015% aluminum, not more than 150 ppm oxygen, and the balance iron and incidental impurities, the value of Mn content(weight %)/Si content (weight %) being not less than 20.

8. A Fe—Ni based alloy sheet having superior surface characteristic and superior etchability according to claim 7, said Fe—Ni based alloy sheet having inclusions, said inclusions having a MnO—$SiO_2$ eutectic composition as the main component.

9. A Fe—Ni based alloy sheet having superior surface characteristic and superior etchability according to claim 7, said Fe—Ni based alloy sheet having a thickness not more than 0.15 mm.

10. A Fe—Ni based alloy sheet having superior surface characteristic and superior etchability, essentially consisting, by weight, of 30 to 50% nickel, 0.05 to 0.5% manganese, 0.001 to 0.02% silicon, not more than 0.0015% aluminum, not more than 90 ppm oxygen, and the balance iron and incidental impurities, the value of Mn content(weight %)/Si content (weight %) being not less than 20.

11. A Fe—Ni based alloy sheet having superior surface characteristic and superior etchability according to claim 10, said Fe—Ni based alloy sheet having inclusions, said inclusions having a MnO—$SiO_2$ eutectic composition as the main component.

12. A Fe—Ni based alloy sheet having superior surface characteristic and superior etchability according to claim 10, said Fe—Ni based alloy sheet having a thickness not more than 0.15 mm.

13. A Fe—Ni based alloy sheet having superior surface characteristic and superior etchability, essentially consisting, by weight, of 30 to 50% nickel, 0.05 to 0.5% manganese, 0.001 to 0.02% silicon, not more than 0.0015% aluminum, not more than 150 ppm oxygen, and the balance iron and incidental impurities, the value of Mn content(weight %)/Si content (weight %) being not less than 60.

14. A Fe—Ni based alloy sheet having superior surface characteristic and superior etchability according to claim 13, said Fe—Ni based alloy sheet having inclusions, said inclusions having MnO—$SiO_2$ eutectic compositions as the main component.

15. A Fe—Ni based alloy sheet having superior surface characteristic and superior etchability according to claim 13, said Fe—Ni based alloy sheet having a thickness not more than 0.15 mm.

16. A Fe—Ni based alloy sheet having superior surface characteristic and superior etchability, essentially consisting, by weight, of 30 to 50% nickel, 0.05 to 0.5% manganese, 0.001 to 0.02% silicon, not more than 0.0015% aluminum, not more than 150 ppm oxygen, not more than 0.005% sulfur, not more than 0.005% boron, and the balance iron and incidental impurities, the value of Mn content(weight %)/Si content (weight %) being not less than 20.

17. A Fe—Ni based alloy sheet having superior surface characteristic and superior etchability according to claim 16, said Fe—Ni based alloy sheet having inclusions, said inclusions having a MnO—$SiO_2$ eutectic composition as the main component.

18. A Fe—Ni based alloy sheet having superior surface characteristic and superior etchability according to claim 16, said Fe—Ni based alloy sheet having a thickness not more than 0.15 mm.

* * * * *